US011260518B2

(12) United States Patent
Lopano et al.

(10) Patent No.: US 11,260,518 B2
(45) **Date of Patent: *Mar. 1, 2022**

(54) ERGONOMIC HANDLE FOR POWER TOOL

(71) Applicant: BLACK & DECKER INC., New Britain, CT (US)

(72) Inventors: Daniel P. Lopano, Bel Air, MD (US); Gabriel Concari, Eldersburg, MD (US); Sion Netzler, Abingdon, MD (US); Dustin Lee, Worthington, OH (US)

(73) Assignee: Black & Decker Inc., New Britain, CT (US)

( * ) Notice: Subject to any disclaimer, the term of this patent is extended or adjusted under 35 U.S.C. 154(b) by 242 days.

This patent is subject to a terminal disclaimer.

(21) Appl. No.: 16/427,555

(22) Filed: May 31, 2019

(65) Prior Publication Data

US 2019/0314973 A1 Oct. 17, 2019

Related U.S. Application Data

(63) Continuation of application No. 13/570,676, filed on Aug. 9, 2012, now Pat. No. 10,350,744, which is a (Continued)

(51) Int. Cl.
*B25F 5/02* (2006.01)

(52) U.S. Cl.
CPC ..... *B25F 5/02* (2013.01)

(58) Field of Classification Search
CPC ..... B25F 5/02; B25G 1/102; Y10T 16/476
See application file for complete search history.

(56) References Cited

U.S. PATENT DOCUMENTS 3,019,673 A 2/1962 Sjostrand et al.
3,488,825 A 1/1970 Lundgren
(Continued)

FOREIGN PATENT DOCUMENTS

DE 9209725 U1 10/1992
DE 20102675 U1 5/2001
(Continued)

OTHER PUBLICATIONS

Drawings and photographs of power tools existing before the filing date of the present application; online: http://www.hitachi-koki.co.jp/products/drill/wh14dbl/wh14dbl.html; printed Jan. 10, 2008.
(Continued)

*Primary Examiner* — Andrew M Tecco
(74) *Attorney, Agent, or Firm* — Scott B. Markow

(57) ABSTRACT

An ergonomic handle is disclosed for use with a power tool, the power tool having a power source, a housing containing a source of motion, and a tool holder coupled the housing and defining a tool holder axis and a forward direction toward a working end of the tool and rearward direction away from the working end of the tool. The handle includes a handle portion having a proximal end coupled to the housing and a distal end coupleable to the power source, and defining, from the proximal end to the distal end, a first region, a second region, a third region, and a fourth region, and defining a handle axis that is generally transverse to the tool holder axis. The first region includes a switch for actuating the source of motion and adapted to receive a user's thumb and forefinger when the forefinger is actuating the switch. The second region is adapted to receive the user's middle finger, the third region is adapted to receive the user's ring finger; and the fourth region adapted to receive the user's pinky finger. Each of the second region, the third region, and the fourth region includes a generally oval cross
(Continued)

section having a major axis and a minor axis. The cross section having the longest major axis is positioned in the third region, the cross section having the shortest major axis is positioned in the fourth region, the cross section having the shortest minor axis is positioned in the second region, and the cross section having the longest minor axis is positioned in the fourth region.

20 Claims, 15 Drawing Sheets

Related U.S. Application Data continuation of application No. 12/707,038, filed on Feb. 17, 2010, now Pat. No. 8,267,192.

(60) Provisional application No. 61/208,399, filed on Feb. 24, 2009.

(56) References Cited

U.S. PATENT DOCUMENTS 4,330,093 A 5/1982 Chapman, Jr.
4,739,838 A 4/1988 Marks
D295,714 S 5/1988 Sasaki et al.
D298,509 S 11/1988 Brosius et al.
4,858,811 A 8/1989 Brosius et al.
D314,320 S 2/1991 Brosius et al.
D323,276 S 1/1992 Fushiya et al.
D329,580 S 9/1992 Sasaki et al.
D340,393 S 10/1993 Okumura
5,353,474 A 10/1994 Good et al.
D380,952 S 7/1997 Kim
5,687,802 A 11/1997 Spooner et al.
D388,678 S 1/1998 Bantly et al.
D393,580 S 4/1998 Bantley et al.
D393,581 S 4/1998 McCallops et al.
D395,387 S 6/1998 Snider
5,778,989 A 7/1998 Neumaier
5,829,099 A * 11/1998 Kopelman ..... B25G 1/102 16/430
D413,242 S 8/1999 Robson
5,979,015 A 11/1999 Tamaribuchi
6,155,354 A 12/2000 Pusateri
6,161,256 A 12/2000 Quiring et al.
6,170,579 B1 1/2001 Wadge
D440,850 S 4/2001 Ozawa et al.
6,308,378 B1 10/2001 Mooty et al.
6,364,033 B1 4/2002 Hung et al.
6,392,381 B1 5/2002 Chen
D458,103 S 6/2002 Chen
D458,824 S 6/2002 Chen
D459,177 S 6/2002 Chen
D467,483 S 12/2002 Heun
D472,781 S 4/2003 Netzler
D475,596 S 6/2003 Ozawa et al.
D477,205 S 7/2003 Sakai et al.
6,615,930 B2 9/2003 Bongers-Ambrosius et al.
D484,385 S 12/2003 Sakai et al.
6,688,407 B2 2/2004 Etter et al.
6,729,415 B1 5/2004 Huang
D496,843 S 10/2004 Sugawara et al.
6,799,643 B2 10/2004 Voulkidis et al.
D499,945 S 12/2004 Sugawara et al.
D500,653 S 1/2005 Concari
6,840,335 B1 1/2005 Wu
D504,604 S 5/2005 Leasure et al.
6,905,052 B2 6/2005 Sakai et al.
6,912,790 B2 7/2005 James et al.
D508,642 S 8/2005 Kokawa et al.
D508,836 S * 8/2005 Schiller ..... D8/68
D509,119 S 9/2005 Schiller et al.
6,938,706 B2 9/2005 Ng
6,988,295 B2 * 1/2006 Tillim ..... B43K 23/004 16/430
D519,808 S 5/2006 Otsuka et al.
D520,832 S 5/2006 Ozawa et al.
D520,834 S 5/2006 Furuta et al.
D524,136 S 7/2006 Taniguchi et al.
D525,099 S 7/2006 Nagasaka et al.
D525,505 S 7/2006 Ito et al.
D525,848 S 8/2006 Kokawa
D527,237 S 8/2006 Otsuka et al.
D527,971 S 9/2006 Kokawa
D528,888 S 9/2006 Nagasaka et al.
7,108,079 B2 9/2006 Sakai et al.
D531,476 S 11/2006 Kokawa et al.
7,134,510 B2 11/2006 Justis et al.
D533,422 S 12/2006 Ino et al.
D533,423 S 12/2006 Ino et al.
D536,943 S 2/2007 Tsai et al.
D539,110 S 3/2007 Okuda
D540,639 S 4/2007 Watson
D540,640 S 4/2007 Clay
D543,081 S 5/2007 Watson
D545,159 S 6/2007 Schoen et al.
D546,154 S 7/2007 Fong et al.
D551,047 S 9/2007 Lopano et al.
D556,002 S 11/2007 Ino
7,506,409 B2 * 3/2009 Tillim ..... B25G 1/102 16/430
8,261,853 B2 * 9/2012 Hachisuka ..... B25F 5/02 173/170
8,267,192 B2 * 9/2012 Lopano ..... B25F 5/02 173/170
10,350,744 B2 * 7/2019 Lopano ..... B25F 5/02
2001/0011884 A1 8/2001 Sakaibara
2002/0059731 A1 5/2002 Zeiler et al.
2002/0096341 A1 7/2002 Hagan et al.
2002/0100347 A1 8/2002 Daubinger
2003/0066666 A1 4/2003 Etter et al.
2003/0074766 A1 * 4/2003 Tillim ..... G05G 1/06 16/430
2003/0159843 A1 * 8/2003 Sakai ..... B25B 21/02 173/216
2004/0029426 A1 2/2004 Liu et al.
2004/0105036 A1 6/2004 Geis et al.
2005/0121209 A1 6/2005 Shimizu et al.
2005/0157489 A1 7/2005 Oomori et al.
2005/0257944 A1 * 11/2005 Cooper ..... B25F 5/006 173/217
2005/0269884 A1 12/2005 Teranishi et al.
2006/0048959 A1 3/2006 Sakai et al.
2006/0060366 A1 3/2006 Bodine et al.
2006/0075605 A1 4/2006 Lagaly et al.
2006/0102367 A1 5/2006 Etter et al.
2006/0143866 A1 7/2006 Lagaly et al.
2006/0175069 A1 * 8/2006 Sakakibara ..... B25F 5/02 173/217
2006/0243469 A1 11/2006 Webster
2007/0193761 A1 8/2007 Brotto
2007/0277987 A1 12/2007 Meyer et al.
2008/0263829 A1 10/2008 Diaslo
2009/0120658 A1 5/2009 Kuhnle et al.

FOREIGN PATENT DOCUMENTS

DE 20315329 U1 3/2004
EP 0261260 A1 3/1988
EP 1690649 A1 8/2006
EP 0142650 A1 8/2007
GB 2169541 7/1986
GB 2392002 2/2004
JP 9002550 1/1997
JP 9239672 9/1997
JP 9295285 11/1997
JP 10044054 2/1998
JP 10086078 4/1998
JP 11221781 8/1999
JP 2000070777 3/2000
JP 2001162565 6/2001

(56) References Cited

FOREIGN PATENT DOCUMENTS

| | | |
|---|---|---|
| JP | 2001198856 | 7/2001 |
| JP | 2001211559 | 8/2001 |
| JP | 2002337074 | 11/2002 |
| JP | 2003039346 | 2/2003 |
| JP | 2003209960 | 7/2003 |
| JP | 2003211374 | 7/2003 |
| JP | 2003290689 | 7/2003 |
| JP | 2003245876 | 9/2003 |
| JP | 2004174670 | 6/2004 |
| JP | 2004174671 | 6/2004 |
| JP | 2004249422 | 9/2004 |
| JP | 2004261906 | 9/2004 |
| JP | 2005199406 | 7/2005 |
| JP | 2005297119 | 10/2005 |
| JP | 2006000948 | 1/2006 |
| JP | 2006116626 | 5/2006 |
| JP | 2006123086 | 5/2006 |
| JP | 2007307626 | 11/2007 |
| WO | WO-88/02242 | 4/1998 |

OTHER PUBLICATIONS

Drawings and photographs of power tools existing before the filing date of the present application; Powerpoint presentation.

Drawing and photograph of power tools existing before the filing date of the present application; Panasonic Power Tool—online: http://www2.panasonic.com/consumer-electronics/shop/Building-Products/Cordless-Tools/Drill-Drivers/model EY7440LN2S_7000000000000005702; printed Feb. 7, 2008.

Search Report for European application No. 1 690 649 dated May 17, 2006.

Hitachi Cordless Driver Drill DB10DL, Handling Instructions, http://www.hitachi-koki.com/manual_view_export/pdf_manual_view.do?implentationWorkNumber=710&partsCode=99167821&model=DB10DL&marketSeq=5, online, cover page, pp. 1 and 48, printed Apr. 1, 2009.

* cited by examiner

ERGONOMIC HANDLE FOR POWER TOOL

RELATED APPLICATIONS

This application claims priority under 35 U.S.C. 120 as a continuation of U.S. patent application Ser. No. 13/570,676, filed Aug. 9, 2012, titled "Ergonomic Handle for Power Tool," which is a continuation of U.S. patent application Ser. No. 12/707,038, filed Feb. 17, 2010, titled "Ergonomic Handle for Power Tool" (now U.S. Pat. No. 8,267,192), which in turn claims priority under 35 U.S.C. § 119(e) to U.S. Provisional Patent Application No. 61/208,399, filed Feb. 24, 2009, titled "Ergonomic Handle for Power Tool." Each of the foregoing applications is incorporated by reference.

TECHNICAL FIELD

This application relates to an ergonomic handle for a power tool, such as a drill or impact driver.

BACKGROUND

Power tools, such as electric drills or impact drivers, generally have a housing, a tool holder coupled to the housing, a handle that extends from the housing, and a power source (e.g., a battery or an AC cord) that is coupled to the handle away from the housing. However, many power tool handles are configured in a manner that may cause significant fatigue or stress in the user when the power tool is used for an extended period of time.

SUMMARY

In one implementation, an ergonomic handle for a power tool is configured to reduce user fatigue and/or stress during periods of extended use. The power tool has a housing that contains a source of motion (e.g., a motor). The source of rotary motion is coupled directly or indirectly (e.g., by a transmission such as a planetary gear train or beveled gear train) to a working end of the tool that is coupled to a first end portion of the housing. The working end includes an output shaft or spindle that defines an output axis. The power tool also includes a handle with a proximal end portion coupled to the housing and a distal end portion coupled to a power source (e.g., a battery, an AC cord, or a source of compressed air). The handle extends generally along a handle axis that is at an angle to the output axis. In one implementation, the angle may be such that the distal end portion is located rearward of the proximal end portion. In another implementation, the battery may define an axis that is substantially parallel to the handle axis.

From the proximal end to the distal end, the handle defines a first, second, third, and fourth region. The first region includes a trigger for actuating the source of rotary motion, and is adapted to receive the user's thumb, and the user's forefinger when the forefinger is actuating the trigger. The second region is adapted to receive the user's middle finger when the trigger is being actuated. The third region is adapted to receive the user's ring finger when the trigger is being actuated. The fourth region is adapted to receive the user's pinky finger when the trigger is being actuated. It should be understood that the positions of the user's fingers on the first through fourth regions are rough approximations and may vary from user to user. It should also be understood that the user's fingers may be positioned differently when the trigger is not being actuated.

In another implementation, an ergonomic handle is disclosed for use with a power tool, the power tool having a power source, a housing containing a source of motion, and a tool holder coupled the housing and defining a tool holder axis and a forward direction toward a working end of the tool and rearward direction away from the working end of the tool. The handle includes a handle portion having a proximal end coupled to the housing and a distal end coupleable to the power source, and defining, from the proximal end to the distal end, a first region, a second region, a third region, and a fourth region, and defining a handle axis that is generally transverse to the tool holder axis. The first region includes a switch for actuating the source of motion and adapted to receive a user's thumb and forefinger when the forefinger is actuating the switch. The second region is adapted to receive the user's middle finger, the third region is adapted to receive the user's ring finger; and the fourth region adapted to receive the user's pinky finger. Each of the second region, the third region, and the fourth region includes a generally oval cross section having a major axis and a minor axis. The cross section having the longest major axis is positioned in the third region, the cross section having the shortest major axis is positioned in the fourth region, the cross section having the shortest minor axis is positioned in the second region, and the cross section having the longest minor axis is positioned in the fourth region.

In another implementation, the distal end defines a rearward-most point on the handle, the rearward-most point being located at or more further rearward than any point on any portion of the second, third, and fourth regions. A rearward edge of the second, third, and fourth regions is shaped like a top-half of a parenthesis. A proximal end of the second region defines a forward-most point on the second, third, and fourth regions of the handle, the forward-most point located at or more forward than any other point on the second, third, and fourth regions. A forward edge of the second, third, and fourth regions has a shape like a bottom half of a parenthesis, with a slight curvature in the forward direction at a distal end of the bottom half of the parenthesis.

In another implementation, the first portion has a thumb-forefinger recess on a rearward portion of the first portion. The thumb-forefinger recess has a curvature configured to receive a web between the user's thumb and forefinger. An imaginary line drawn between a center point of a radius of the thumb-forefinger recess and a center-point of the switch is substantially parallel to the tool holder axis.

In another implementation, the first portion includes a thumb-knuckle recess configured to receive the thumb knuckle of the user. When viewed in a cross-section taken generally transverse to the tool holder axis, the thumb-knuckle recess has a curvature opposite to the curvature of the remainder of the handle.

In another implementation, a rearward portion of the fourth region includes a palm grip relief that is configured to receive hypothenar muscles of the palm. When viewed in a cross-section substantially parallel to the tool holder axis, the handle portion has a first generally elliptical shape and the palm grip relief surface has a second, different shape. The first generally elliptical shape has a first minor axis centered on a central plane of the handle portion, and the second shape is a second elliptical shape having a minor axis that is not centered on the central plane. The minor axis of the second elliptical shape is larger than the minor axis of the first elliptical shape.

In another implementation, the handle portion includes a finger support ridge that runs along a side of the handle, the finger support ridge starting adjacent to the switch in the first region and extending in a rearward direction substantially parallel to the tool holder axis. The finger support ridge further extends through the second and third regions substantially parallel to the handle axis. The finger support ridge further extends through the fourth section in a curved section that extends forward and then rearward as it extends distally.

In other implementations, the housing may be substantially transverse to the handle axis (e.g., a piston-grip drill, a hammer drill or an impact driver) or the housing may be substantially parallel to the handle axis (e.g., a right-angle drill).

The handle may be implemented with any one or more of the above implementations. Advantages may include one or more of the following. The handle is contoured to the anatomy of a user's hand. This increases the comfort of the user when using the power tool and reduces user fatigue. This also reduces the occurrence of discomfort when using the tool handle. Other advantages and features will be apparent from the description and the drawings.

DETAILED DESCRIPTION

Figure 1:
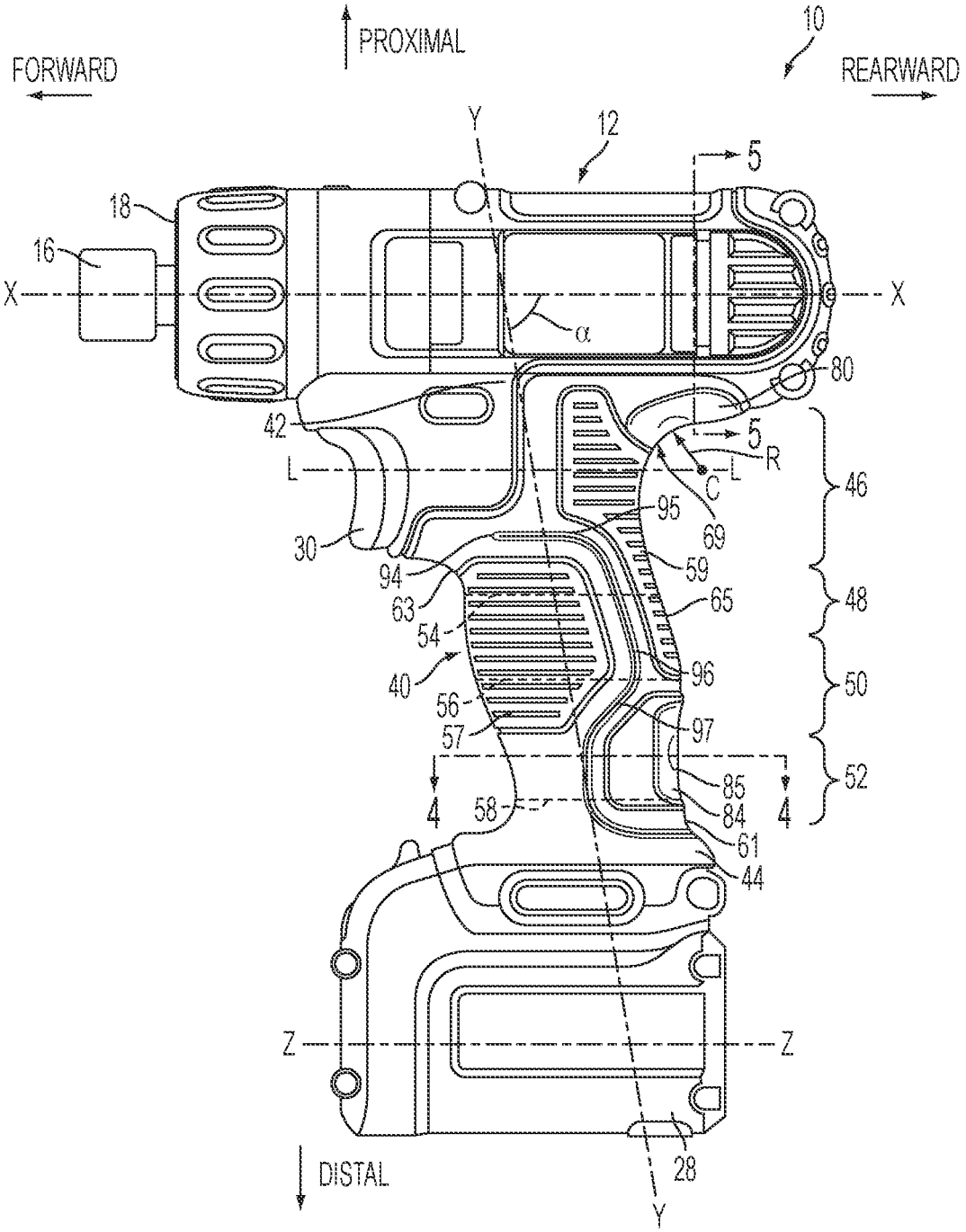
FIG. 1 is a side view of a first embodiment of a power tool having an ergonomic handle.
Figure 9:
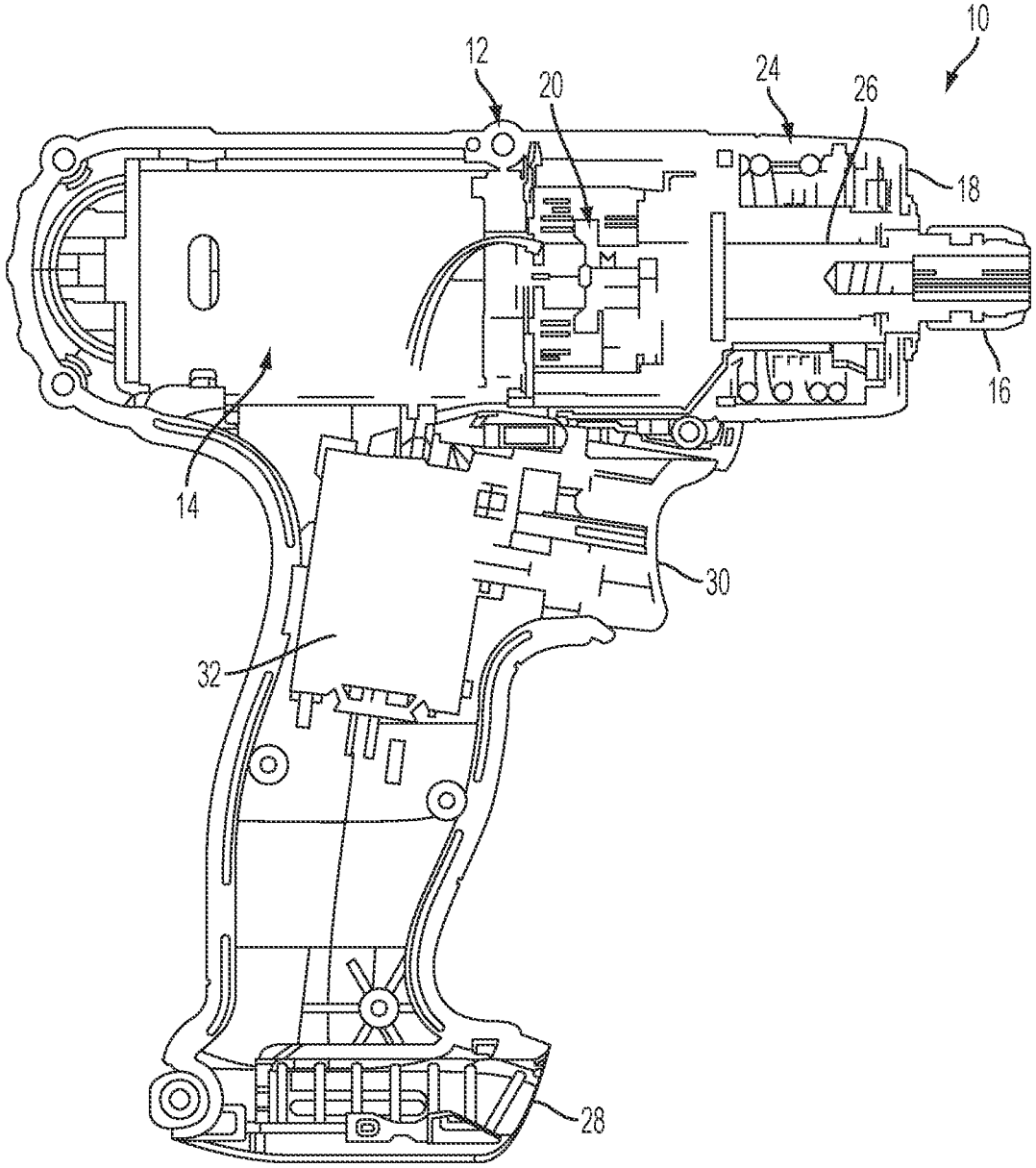
FIG. 9 is a cross-sectional side view of the power tool of FIG. 1, showing interior components of the tool.

Referring to FIGS. 1 and 9, a first embodiment of a power tool 10 has a housing 12 that contains a source of motion, in the form of a rotary motor 14. Coupled to a front end 18 of the housing is a working end of the tool in the form of a tool holder 16 for retaining a tool bit (e.g., a drill bit or screw driving bit, not shown) defining a tool holder axis X-X. As shown, the working end is a hex bit retention mechanism. Further details regarding an exemplary tool bit holder are set forth in commonly-owned U.S. patent application Ser. No. 12/394,426, which is incorporated herein by reference. The working end could also be another element, such as a different hex but retainer, a chuck, or a nosepiece of a nailer or stapler. The motor 14 drives the tool holder 16 in a rotary motion via a transmission gears 20, a clutch 24, and an output spindle 26. The motor is powered by a power source in the form of a battery 28, which is coupled to the motor via a trigger 30 that actuates a switch 32 for selectively activating the motor 14. The battery 28 defines an axis Z-Z that is substantially parallel to the tool bit holder axis X-X. As shown in the drawings, the power tool is a battery powered cordless drill. However, it should be understood that the tool may be any type of corded, cordless, pneumatic, or combustion powered tool, such as a screwdriver, an impact driver or wrench, a hammer, a hammer drill, a nailer, a stapler, a saw, a grinder, a sander, a router, a flashlight.

The power tool 10 also includes a handle 40 with a proximal end portion 42 coupled to the housing 12 and a distal end portion 44 coupled to the battery 28. The handle extends generally along a handle axis Y-Y that is at an angle $\alpha$ to the tool bit holder axis X-X. For example, the angle $\alpha$ may be approximately 80 degrees, such that the distal end portion is located generally rearward of the proximal end portion, although it should be understood that this angle can be varied among a wide range of angles.

Figure 7:
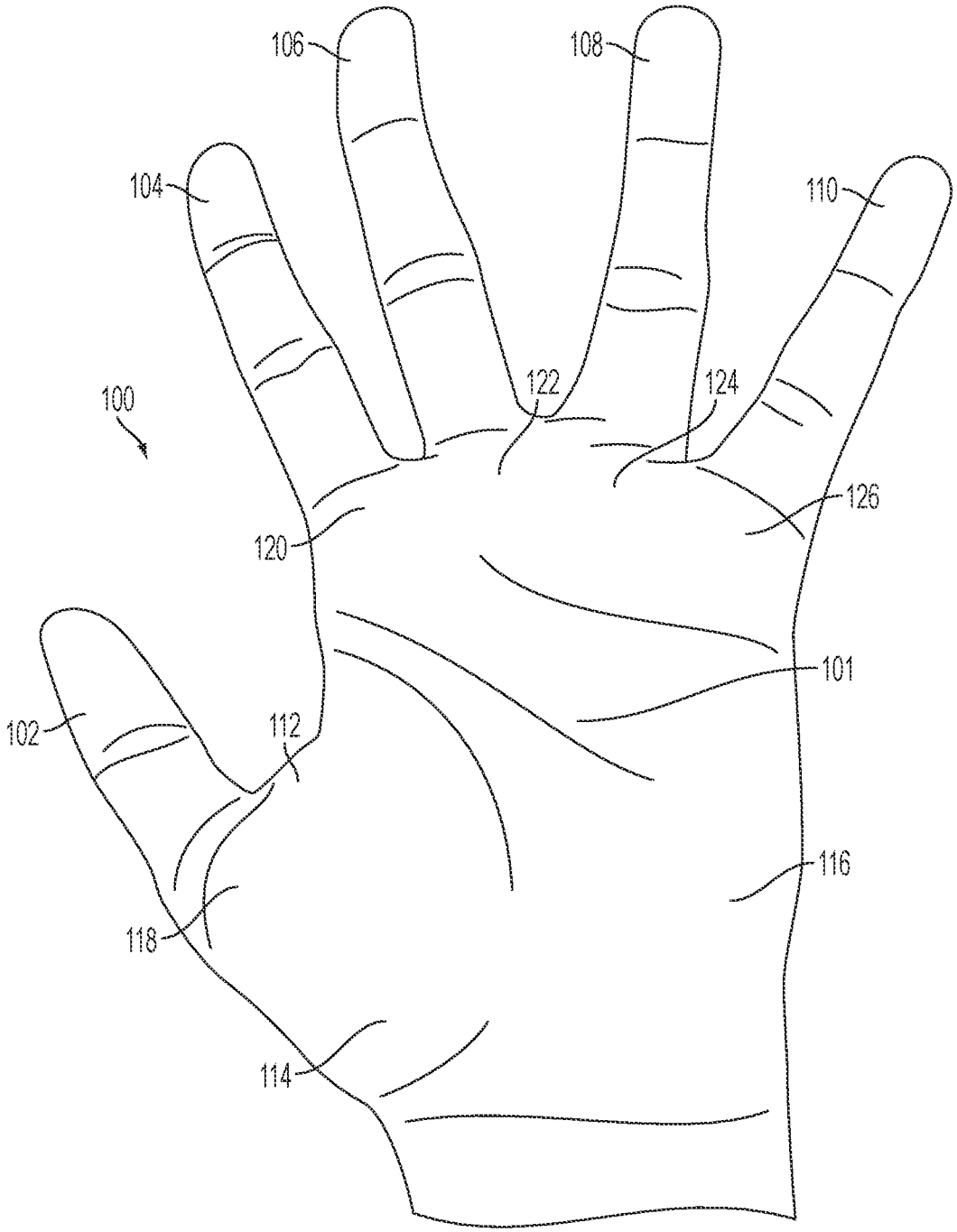
FIG. 7 is an external view of a human hand from the palm side.
Figure 8:
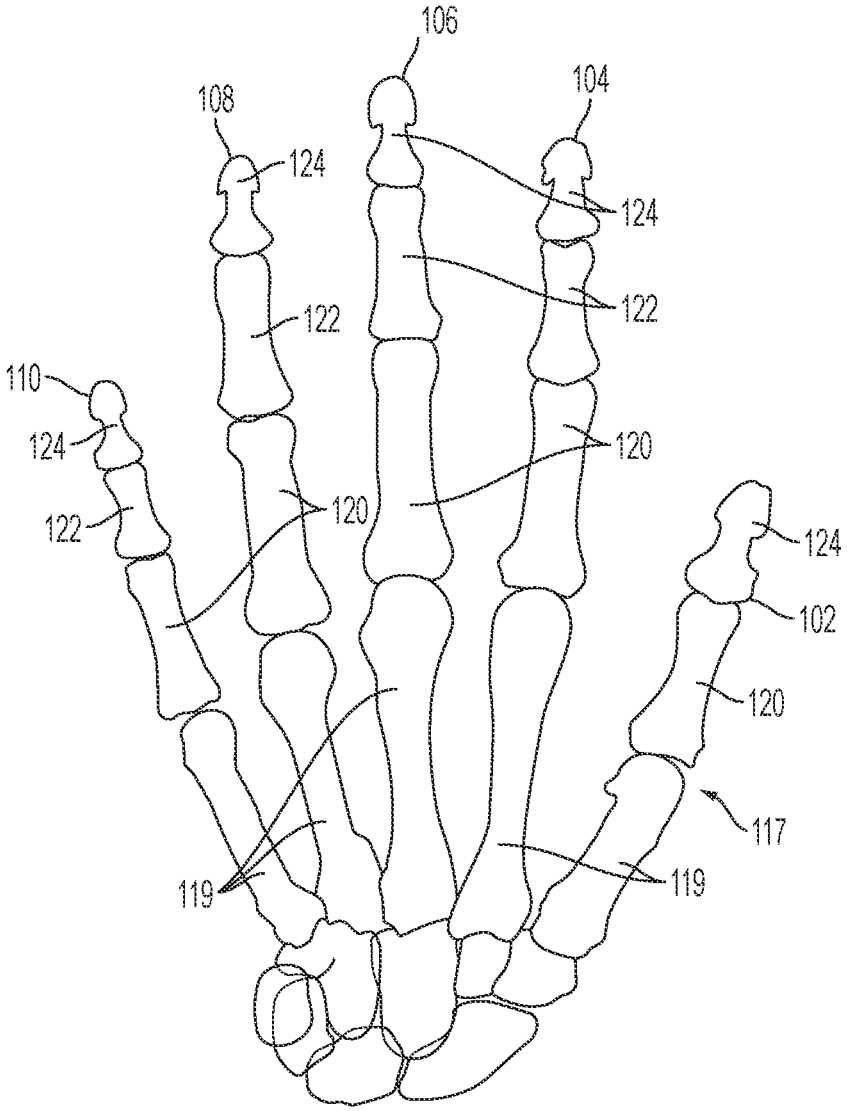
FIG. 8 is a schematic view of the bones of a human hand.

The handle 40 is ergonomically designed to be contoured to a user's hand, the anatomy of which is shown in FIGS. 7 and 8. Generally, a user's hand 100 includes a palm 101 to which is connected a thumb 102, a forefinger 104, a middle finger 106, a ring finger 108, and a pinky finger 110. The palm 101 is formed by five metacarpals 119. Each finger is formed by a proximal phalange 120 coupled to a metacarpal 119, an intermediate phalange 122, and a distal phalange 124. The thumb is formed by a proximal phalange 120 coupled to a metacarpal 119, and a distal phalange 124 coupled to the proximal phalange 120. There are knuckles at the joints between these bones. A web 112 of muscles connects the base of the thumb 102 and forefinger 104. In addition, the palm includes two fleshy pads in the form of the thenar eminence 114 on the thumb side of the palm and the hypothenar eminence 116 on the pinky side of the palm. Further, there are fleshy pads 118, 120, 122, 124, and 126 on the palm side at the base of the thumb and each finger.

Figure 6:
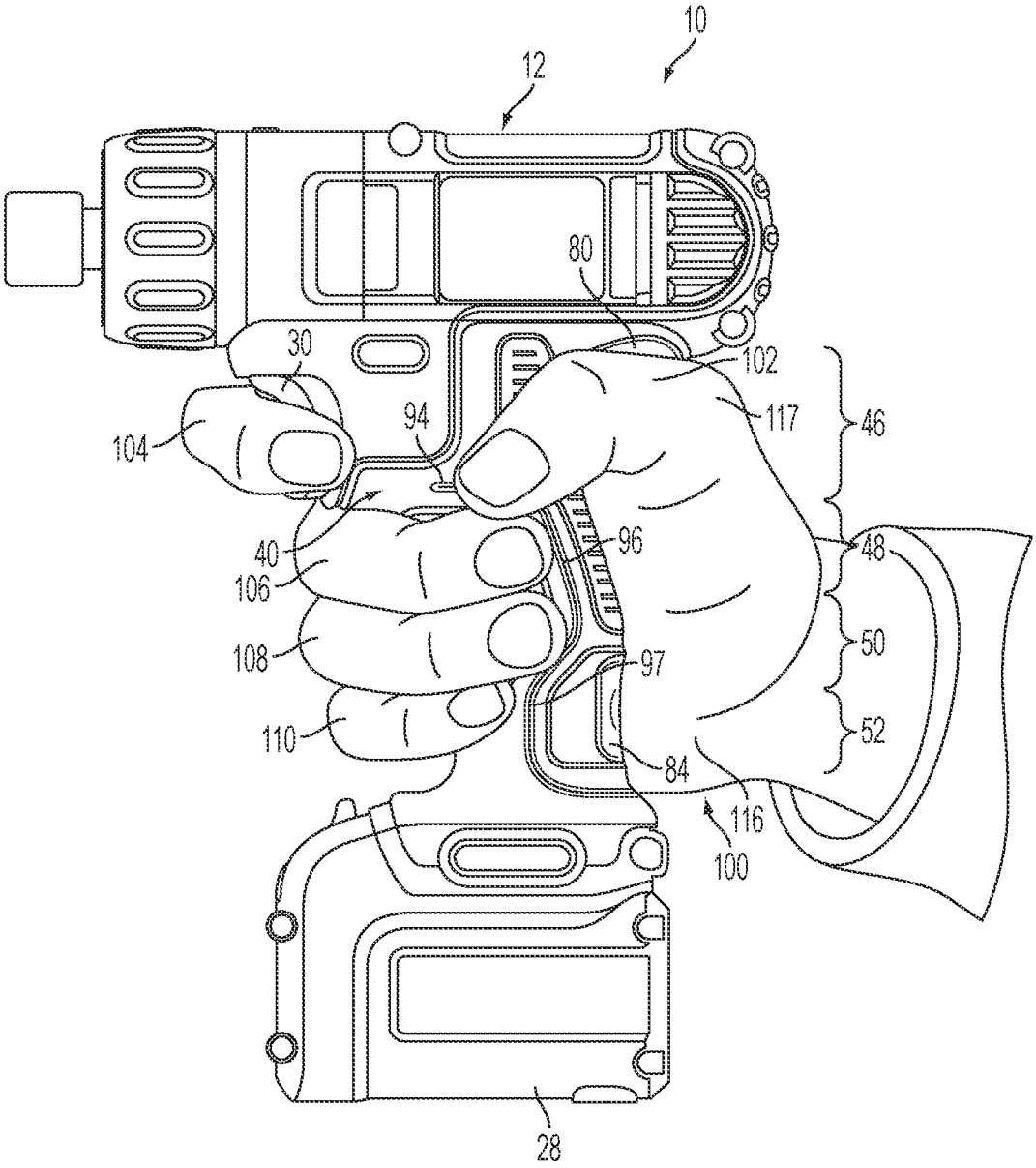
FIG. 6 is a side view of a power tool of FIG. 1 being held in a hand of a user.

Referring to FIGS. 1 and 6, from the proximal end portion 42 to the distal end portion 44, the handle 40 defines a first region 46, a second region 48, third region 50, and fourth region 52, which is adapted to receive the user's hand as follows, while the trigger is being actuated. The first region 46 includes the trigger 30, and is adapted to receive the user's thumb 102 and forefinger 104, while the forefinger 104 actuates the trigger. The second region 48 is adapted to receive the user's middle finger 106. The third region 50 is adapted to receive the user's ring finger 108. The fourth region 52 is adapted to receive the user's pinky finger 110. It should be understood that the positions of the user's fingers on the first through fourth regions are rough approximations and may vary from user to user. It should also be understood that the user's fingers may be positioned differently when the trigger is not being actuated. For example. the forefinger, middle finger, ring finger, and pinky finger may all be received together on the second, third, and fourth regions, with the thumb received on the first region. In one embodiment, the overall length of the second, third, and fourth regions is at least approximately 64 mm, as it has been found that at least this length is needed to receive the hands of a majority of users.

Figure 3:
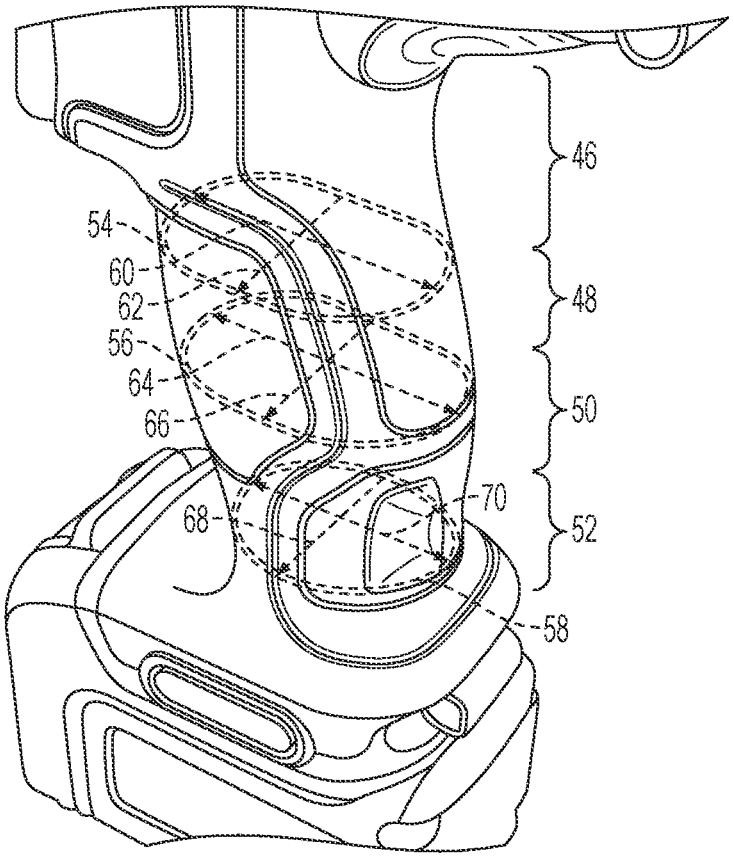
FIG. 3 is a perspective view of the handle of FIG. 1, partially in cross-section.

Referring to FIGS. 1 and 3, each of the second region 48, the third region 50, and the fourth region 52 includes a plurality of generally oval cross sections, each taken approximately parallel to the axis X-X. For sake of clarity, FIG. 3 shows a single exemplary oval cross-section in each of the second region 48, third region 50, and fourth region 52. However, it should be understood that each region has an infinite number of similar cross-sections. The second region 48 contains the generally oval cross-section 54 that has a major axis 60 and a minor axis 62, where the minor axis 62 is the shortest of any other minor axis of any other oval cross-section in the second, third, and fourth regions. For example, the oval cross-section 54 has a minor axis 62 that is approximately 31.5 mm in length. In addition, the major axis 60 is shorter than all of the other major axes in the third region 50, but longer than all of the other major axes in the fourth region 52, for example approximately 42 mm in length. The third region 50 contains the oval cross-section 56 with a major axis 64 and a minor axis 66, where the major axis 64 is the longest of any other major axis in the second, third, or fourth regions, e.g., approximately 44 mm. In addition, the minor axis 66 is longer than all of the other minor axes in the second region 48 and shorter than all of the other minor axes in the fourth region 52, e.g., approximately 32.5 mm. The fourth region has an oval cross-section 58 with a major axis 70 and a minor axis 68, where the minor axis 68 is the longest of any other minor axis in the second, third, or fourth regions, e.g., approximately 34 mm. The major axis 70 is the shortest of any other major axis in the second, third, or fourth regions, e.g., approximately 36 mm.

Figure 2:
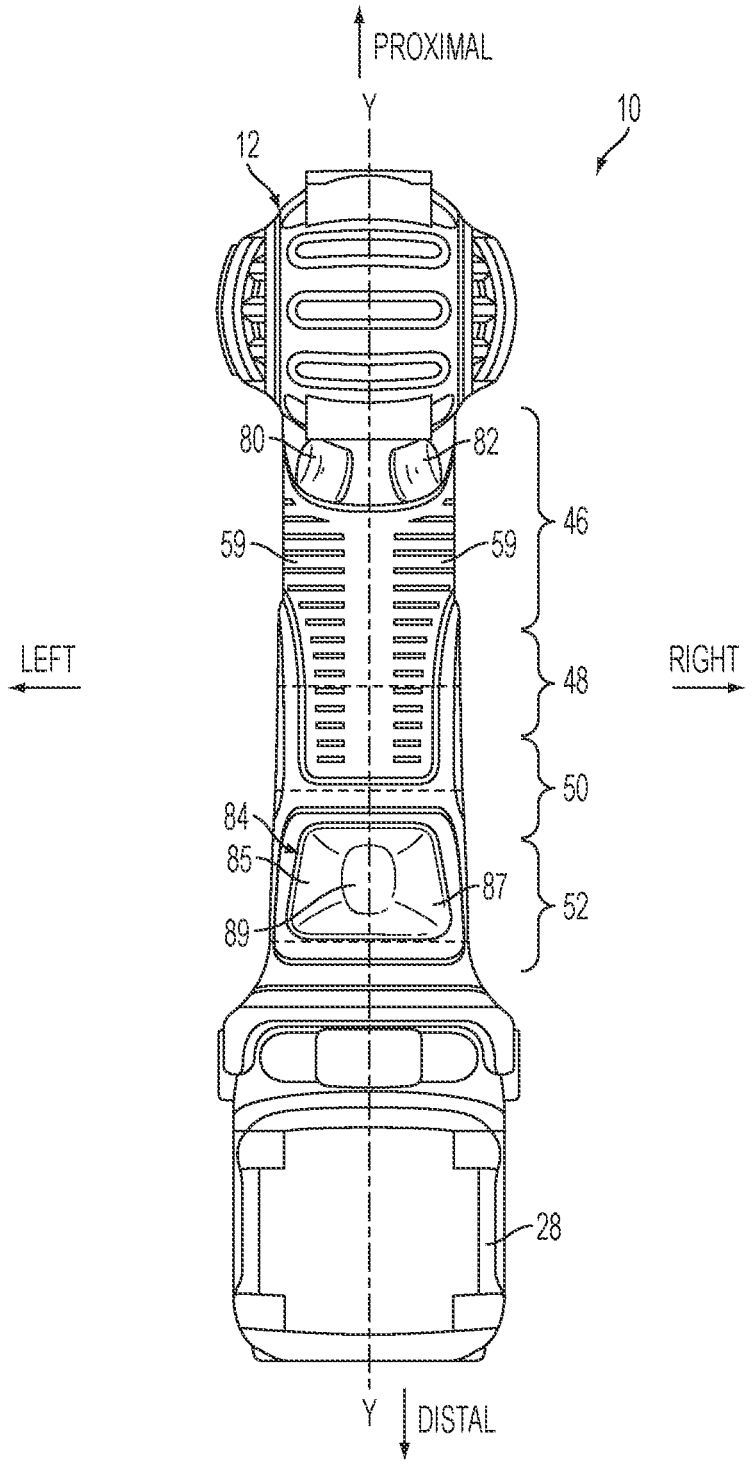
FIG. 2 is a back view of the power tool of FIG. 1.

When the handle 40 is viewed from the rear, as shown in FIG. 2, the minor axes of the handle cross-sections gradually increase in length from the first region 46 to the fourth region 52, such that the handle tapers outwardly in a distal direction. When the handle 40 is viewed from the side, as shown in FIG. 1, the major axes of the handle cross-section increase in length moving distally from the second region 48 into the third region 50, reaching a maximum at oval cross-section 56 in the third region 50. The major axes then decrease in length moving distally from the oval cross-section 56 through the remainder of the third region 50 and through the fourth region 52 reaching a minimum in the fourth region 52 near the junction between the fourth region 52 and the distal end portion 44 of the handle 40.

In addition, as illustrated in FIG. 1, the handle 40 is configured so that the rearward-most point 61 on the second, third, and fourth regions of the handle 40 is located at the distal end of the fourth region 52, such that point 61 is equal to or more rearward than any other point more proximal on the second, third, or fourth regions of the handle 40. The rearward edge 65 of the second, third, and fourth portions of the handle 40 tends to have a curvature approximately like a top-half of a parenthesis. The front-most point 63 on the second, third, and fourth portions of the handle 40 is located at the proximal end of the second region 48, such that point 63 is equal to or more forward than any other point more distal on the second, third, or fourth regions of the handle 40. The frontward edge 67 of the second, third, and fourth portions of the handle 40 tends to have a shape approximately like a bottom half of a parenthesis, with a slight curvature back in the frontward direction at the bottom of the parenthesis.

Referring to FIGS. 1 and 6, the first region 46 includes a semi-circular shaped thumb-forefinger recess 69 having a curvature configured to receive the web 112 between the user's thumb and forefinger. The thumb-forefinger recess 69 has a radius R and a center C. An imaginary line L-L drawn between the center C and a center-point of the trigger 30 is substantially parallel to the tool bit holder axis X-X. The trigger travels along the line L-L such that the trigger travels substantially parallel to the tool holder axis X-X.

Figure 5:
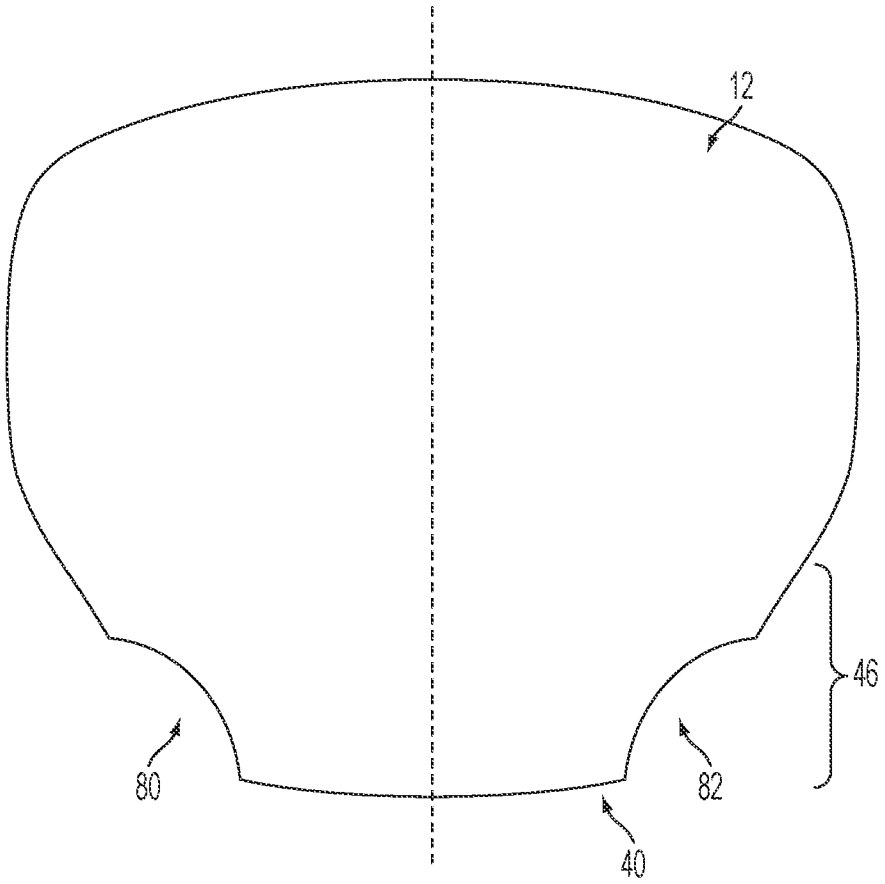
FIG. 5 is a cross-sectional view of the power tool of FIG. 1 taken along line 5-5.

Referring to FIGS. 1, 2, and 6, the first region 46 also includes a pair of thumb-knuckle resting portions 80 and 82 on opposite sides of the handle 40. Each thumb-knuckle resting portion 80 and 82 extends in a generally rearward direction from the front-most point of the portion 80, 82 toward the rear end of the handle to blend with the housing 12. Each of the thumb-knuckle resting portion 80, 82 are configured to receive the thumb knuckle 117 of the user at the junction between proximal phalange 120 and the metacarpal 119 of the thumb 102. There is a thumb-knuckle recess 80, 82 on each side of the tool in order to accommodate both right and left handed users. Referring also to FIG. 5, in cross-section B-B (taken through the housing and the handle generally perpendicular to the tool holder axis X-X), each thumb-knuckle recess 80, 82 has a curvature that is generally inverse to the curvature of the remainder of the housing and handle. In other embodiments, the thumb-knuckle recess may have a flat profile or may have a curvature in the same direction of the housing and handle, but with a different dimension.

Figure 4:
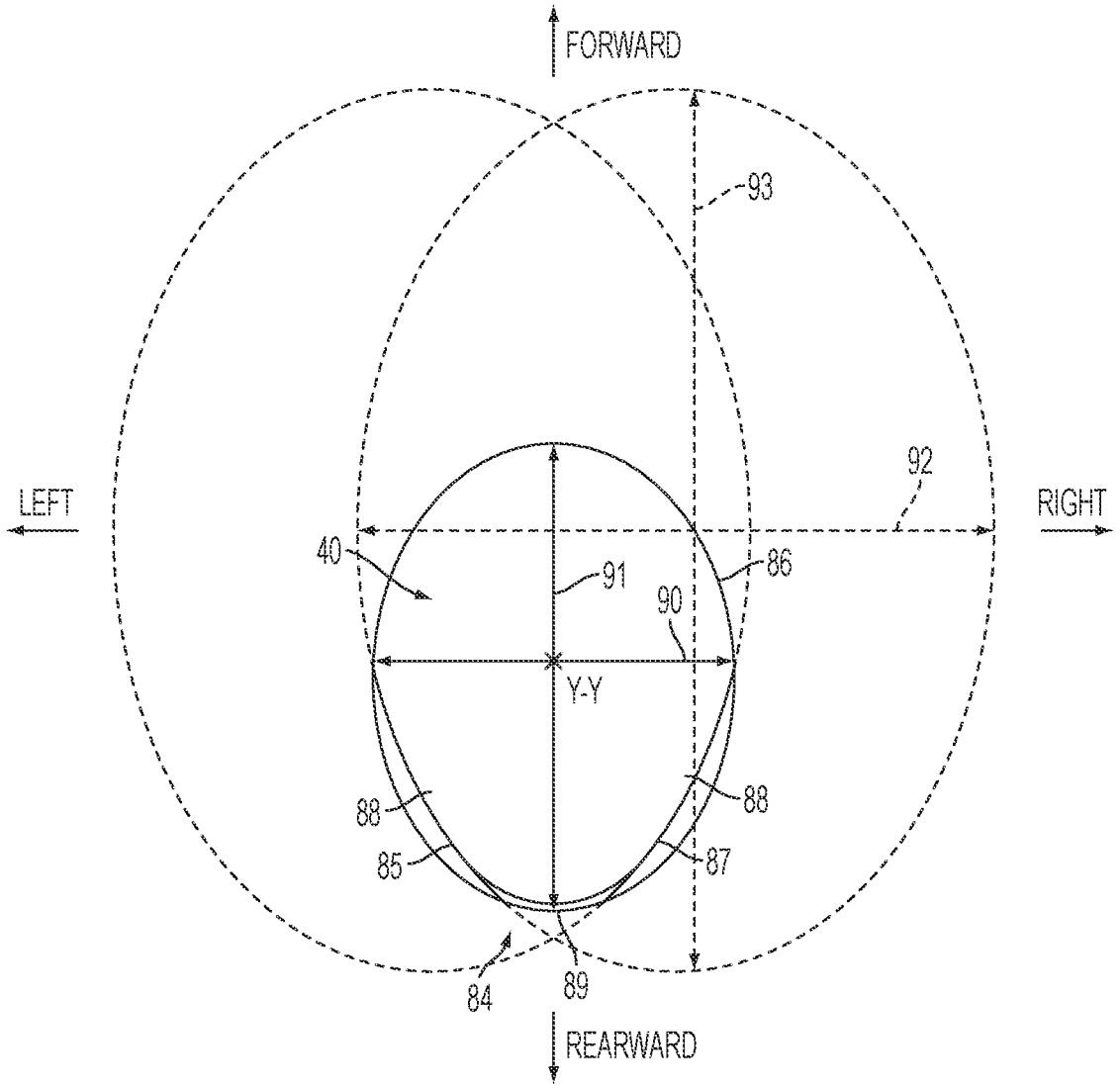
FIG. 4 is a cross-sectional view of the power tool of FIG. 1 taken along line 4-4.

Referring to FIGS. 1, 2, and 6, the fourth region 52 of the handle 40 includes a palm grip relief 84, which is configured to receive the hypothenar eminence 116 of the user's palm. The palm grip relief 84 wraps around the rear of the handle and is symmetrical on both sides of the handle. The palm grip relief includes a left portion 85 and a right portion 87 on opposite sides of the handle 40 that meet at a central portion 89. When viewed from the side view (i.e., as shown in FIG. 1), the left portion 85 and right portion 87 each have a generally C-shape. Referring also to FIG. 4, in cross-section A-A (taken through the handle at the palm-grip relief generally parallel to the tool bit holder axis X-X), the handle 40 has a first generally elliptical shape 86 with the left portion 85 and the right portion 87 of the palm grip relief 84 each having a second generally elliptical shape 88 that is different from the first generally elliptical shape 86. For example, the first generally elliptical shape 86 has a major axis 91 and a minor axis 90, each centered on the handle axis Y-Y, while each second elliptical shape 88 has a major axis 93 that is centered forward of the handle axis Y-Y and a minor axis 92 that is centered to the left or the right of the handle axis Y-Y. In addition, the major axis 93 and minor axis 92 of each second elliptical shape 88 are larger than the major axis 91 and minor axis 90, respectively, of the first elliptical shape 86. Further, each second elliptical shape 88 has a curvature that is different from that of the first elliptical shape 86. In other embodiments, the major and/or minor axes of the second elliptical shapes may be centered in different locations or be smaller than or equal to the major and/or minor axes of the first elliptical shape and/or the second elliptical shape may have a different curvature than that shown. In yet further embodiments, the shape of the left portion 85 and right portion 87 of the palm grip relief 84 may not be elliptical, but instead be a flattened portion, or may have a curvature that us inverse to that of the handle 40.

Referring to FIGS. 1 and 6, the handle 40 also includes a pair of finger support ridges 94 that run along each side of the handle. Each finger support ridge 94 has a first section 95 that starts adjacent to the trigger in the first region 46 and extends in a rearward direction substantially parallel to the axis X-X. The ridge has a second section 96 that extends from the first section 95 and continues through the second and third regions substantially parallel to the handle axis. The ridge also has a third section 97 then continues through the fourth section in a generally curved section that extends forward and then rearward as it extends distally. The third section 97 has a generally C-shaped contour that corresponds to the generally C-shaped contour of the palm grip relief 84. The finger support ridge 94 is configured to abut against the fingertips of the user when the user is gripping the handle, in order to better grip the handle 40. Gripping surfaces 57 are disposed on either side of the finger support ridge 94 and are contoured like the finger support ridge 94. Gripping surfaces 57 are contoured to receive the user's fingertips on one side of the handle 40, while receiving the fleshy pads 120, 122, 124, and 126 on the other side of the handle 40.

Figure 10:
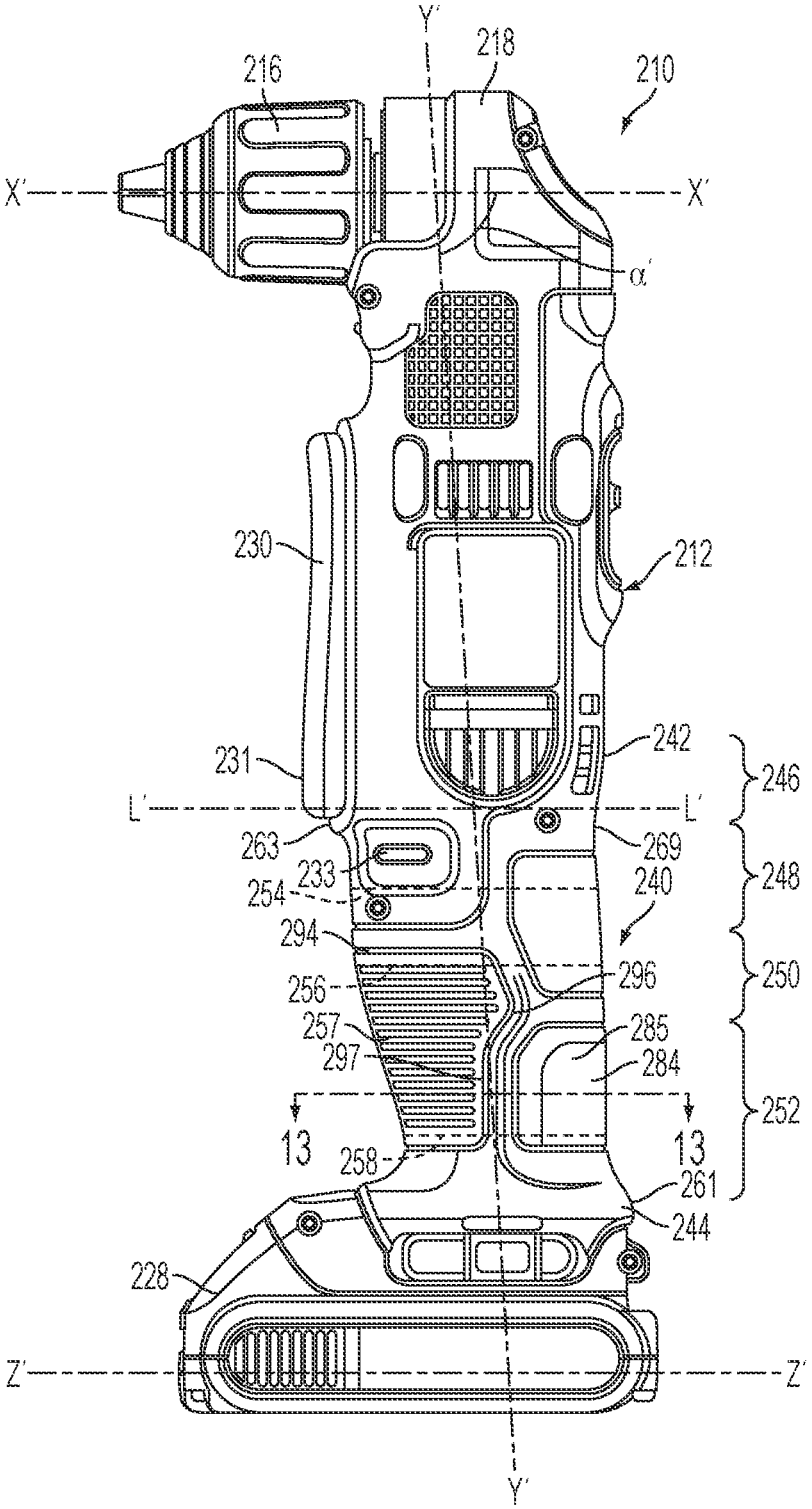
FIG. 10 is a side view of a second embodiment of a power tool having an ergonomic handle.

Referring to FIGS. 10 and 14, a second embodiment of a power tool 210 has a housing 212 that contains a source of motion, in the form of a rotary motor 214. Coupled to a top portion 218 of the housing is a working end of the tool in the form of a tool holder 216 for retaining a tool bit (e.g., a drill bit or screw driving bit, not shown) defining a tool holder axis X'-X'. As shown, the working end is a chuck. The working end could also be another element, such as a hex but retention mechanism (e.g., the one described above with respect to the first embodiment). The motor 214 drives the tool holder 216 in a rotary motion via a transmission 220 that includes a two-stage planetary gear set 222, a right angle gear set 224, and an output spindle 226 to which the tool holder is connected. The motor 214 is powered by a power source in the form of a battery 228, which is coupled to the motor 214 via a trigger 230 that actuates a switch 232 for selectively activating the motor 214. The battery 228 defines an axis Z'-Z' that is substantially parallel to the tool bit holder axis X'-X'. As shown in the drawings, the power tool is a battery powered cordless right-angle drill. However, it should be understood that the tool may be any type of corded, cordless, pneumatic, or combustion powered right angle tool, such as a hammer drill, an impact driver, a screwdriver, or a grinder.

The power tool 210 also includes a handle 240 with a proximal end portion 242 coupled to the housing 212 and a distal end portion 244 coupled to the battery 228. The handle 240 extends generally along a handle axis Y'-Y' that is at an angle $\alpha'$ to the tool bit holder axis X'-X'. For example, the angle $\alpha'$ may be approximately 80-90 degrees, such that the distal end portion is at or approximately generally rearward of the proximal end portion. It should be understood that this angle can be varied among a wide range of angles.

Figure 14B:
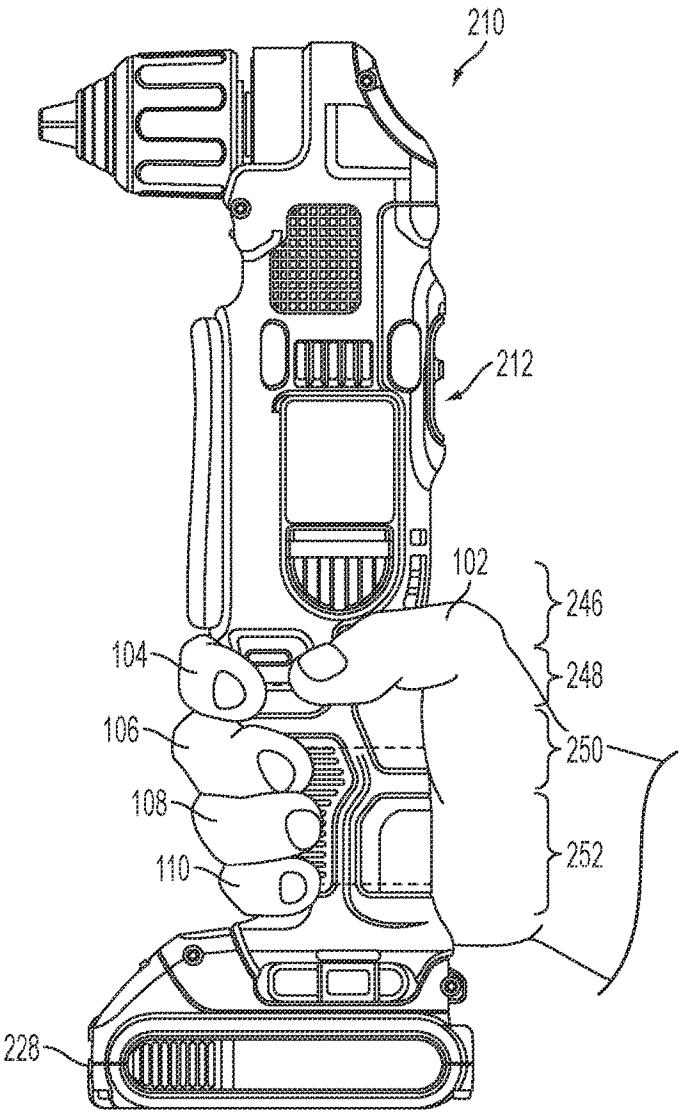
FIG. 14B is a side view of the power tool of FIG. 10 being held in the hand of a user when the trigger is being activated.
Figure 14A:
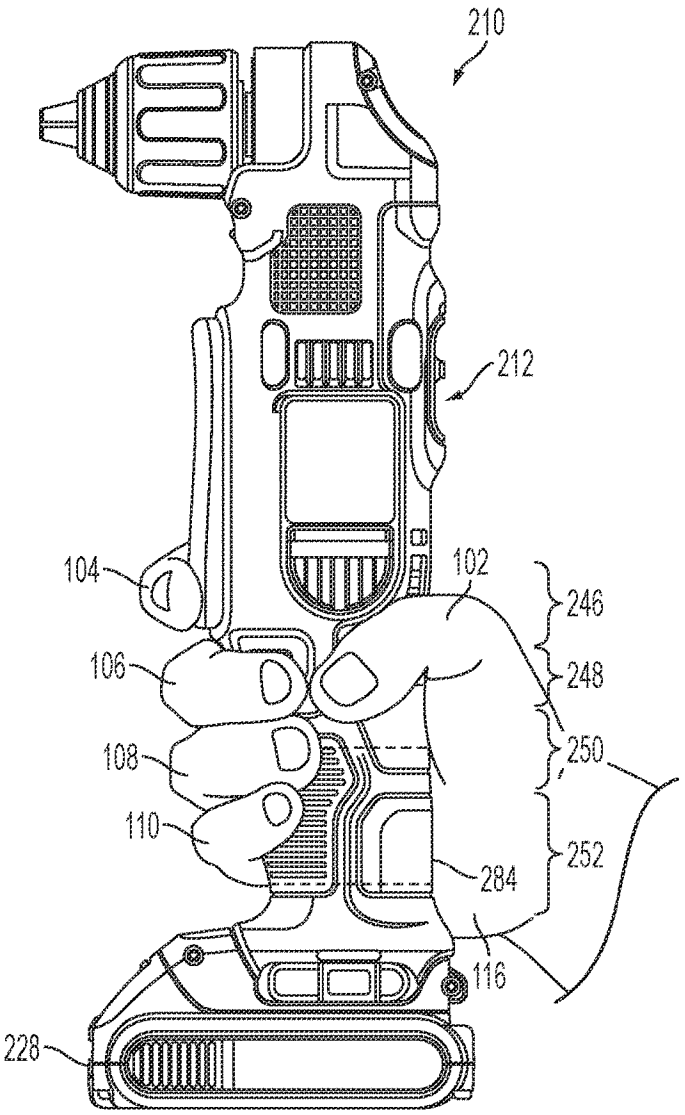
FIG. 14A is a side view of the power tool of FIG. 10 being held in the hand of a user when the trigger is not be activated.
Figure 15:
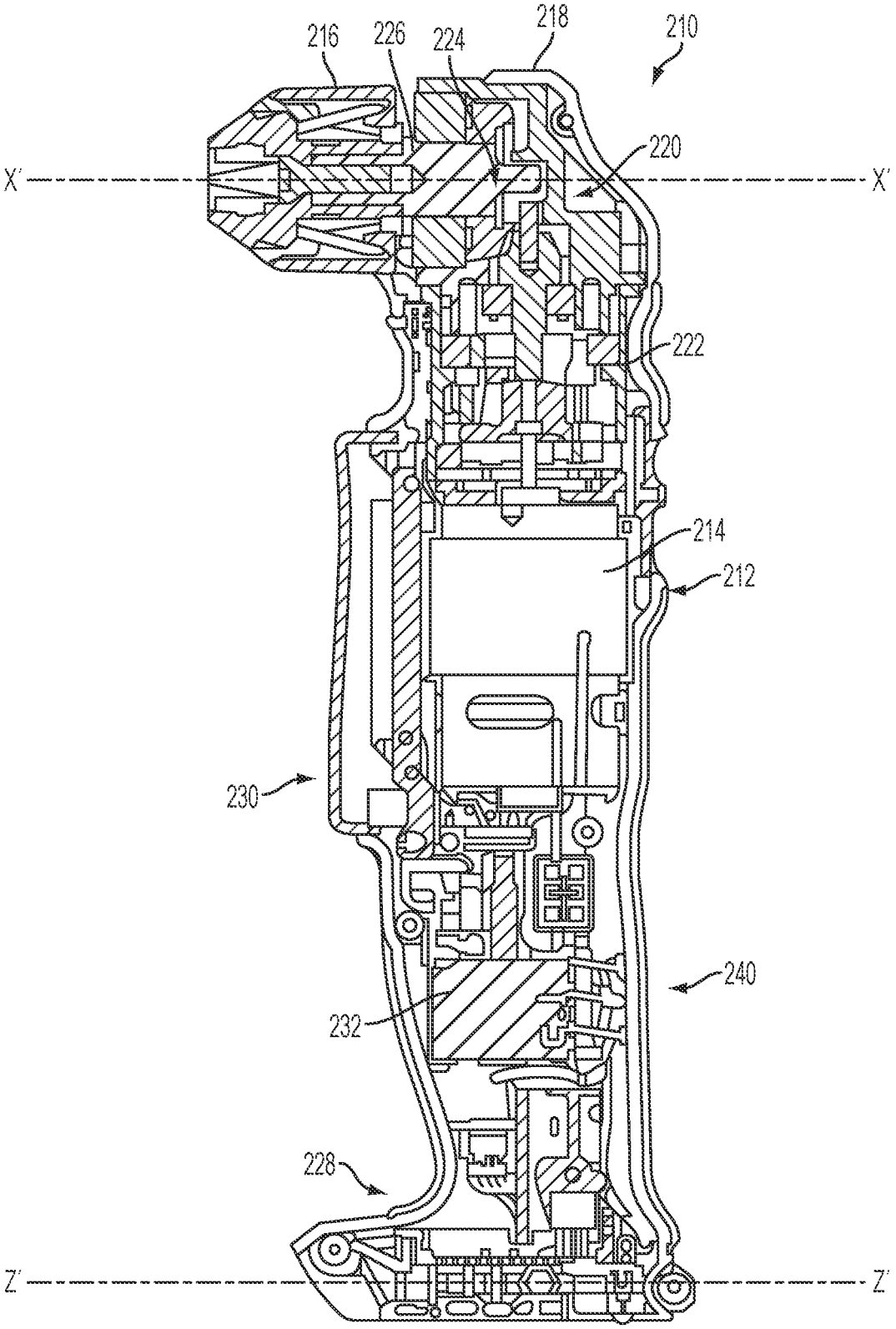
FIG. 15 is a cross-sectional side view of the power tool of FIG. 10, showing interior components of the tool.

The handle 240 is ergonomically designed to be contoured to a user's hand, the anatomy of which is shown and described above in FIGS. 7 and 8. Referring to FIGS. 10, 14A, and 14B from the proximal end portion 242 to the distal end portion 244, the handle 240 defines a first region 246, a second region 248, third region 250, and fourth region 252, which is adapted to receive the user's hand as follows. The first region 246 includes a bottom portion 231 of the trigger 230. The first region is adapted to receive the user's thumb 102 and forefinger 104 when the forefinger 104 is actuating the trigger (FIG. 14A), and is adapted to receive only the user's thumb 102, and no fingers, when the trigger is not being actuated (FIG. 14B). The second region 248 contains a forward-reverse switch 233 for reversing the direction of the motor. The second region 248 is adapted to receive the user's middle finger 106 when the trigger is being actuated (FIG. 14A), and to receive the user's forefinger 104 when the trigger is not being actuated (FIG. 14B), so that the forefinger can actuate the forward-reverse switch 233. The third region 250 is adapted to receive the user's ring finger 108 when the trigger is being actuated (FIG. 14A), and is adapted to receive the user's middle finger 106 when the trigger is not being actuated (FIG. 14B). The fourth region 252 is adapted to receive the user's pinky finger 110 when the trigger is being actuated (FIG. 14A), and is adapted to receive the user's ring finger 108 and pinky finger 110 when the trigger is not being actuated (FIG. 14B). It should be understood that the positions of the user's fingers on the first through fourth regions are rough approximations and may vary from user to user. In one embodiment, the overall length of the second, third, and fourth regions is at least approximately 64 mm, as it has been found that at least this length is needed to receive the hands of a majority of users.

Figure 12:
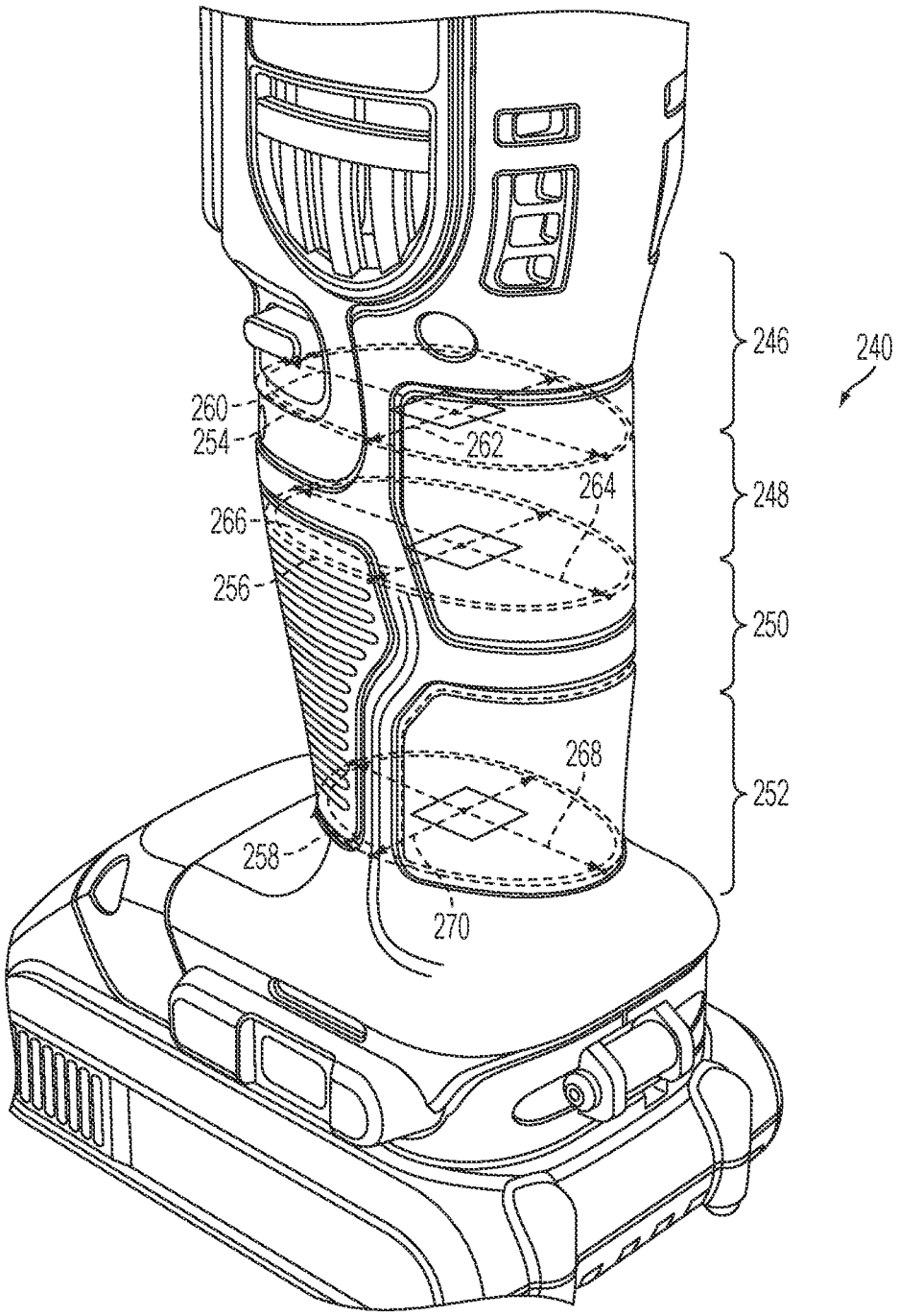
FIG. 12 is a perspective view of the handle of FIG. 10, partially in cross-section.

Referring to FIGS. 10 and 12, each of the second region 248, the third region 250, and the fourth region 252 includes a plurality of generally oval cross sections, each taken approximately parallel to the axis X'-X'. For sake of clarity, FIG. 12 shows a single exemplary oval cross-section in each of the second region 248, third region 250, and fourth region 252. However, it should be understood that each region has an infinite number of similar cross-sections. The second region 248 contains the generally oval cross-section 254 that has a major axis 260 and a minor axis 262, where the minor axis 262 is the shortest of any other minor axis of any other oval cross-section in the second, third, and fourth regions. For example, the oval cross-section 254 has a minor axis 262 that is approximately 35.4 mm in length. In addition, the major axis 260 is shorter than all of the other major axes in the third region 250, but longer than all of the other major axes in the fourth region 252, for example approximately 58 mm in length. The third region 250 contains the oval cross-section 256 with a major axis 264 and a minor axis 266, where the major axis 264 is the longest of any other major axis in the second, third, or fourth regions, e.g., approximately 59 mm. In addition, the minor axis 266 is longer than all of the other minor axes in the second region 248 and shorter than all of the other minor axes in the fourth region 52, e.g., approximately 35.8 mm. The fourth region has an oval cross-section 258 with a major axis 268 and a minor axis 270, where the minor axis 270 is the longest of any other minor axis in the second, third, or fourth regions, e.g., approximately 38 mm. The major axis 268 is the shortest of any other major axis in the second, third, or fourth regions, e.g., approximately 48 mm.

Figure 11:
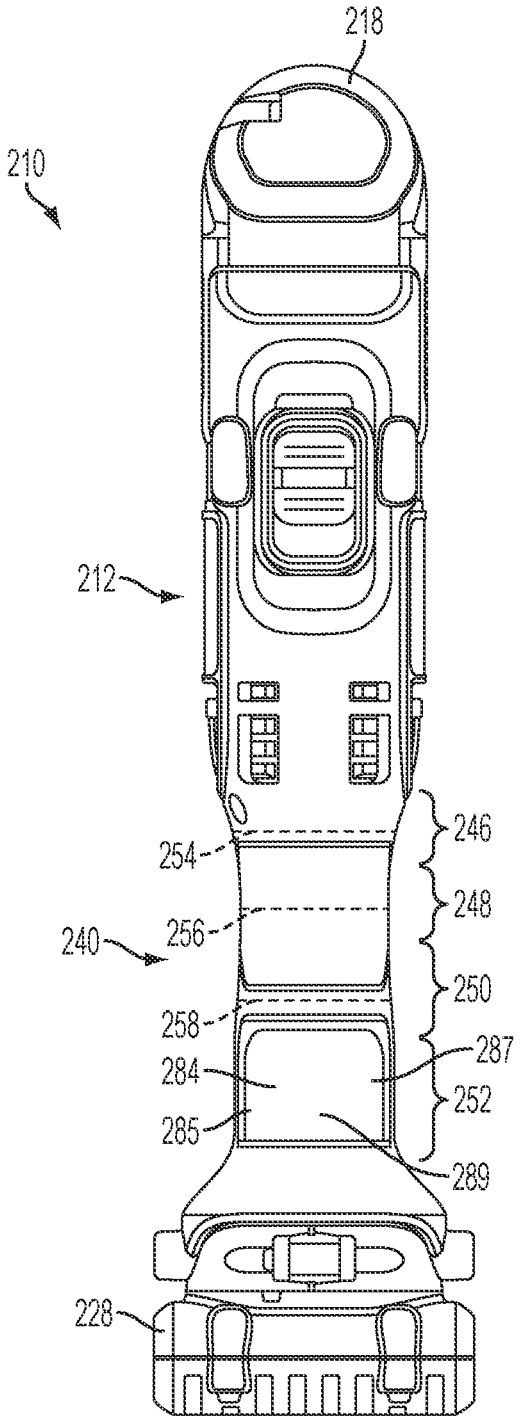
FIG. 11 is a back view of the power tool of FIG. 10.

When the handle 240 is viewed from the rear, as shown in FIG. 11, the minor axes of the handle cross-sections gradually increase in length from the second region 248 to the fourth region 252, such that the handle tapers outwardly in a distal direction. When the handle 40 is viewed from the side, as shown in FIG. 10, the major axes of the handle cross-section increase in length moving distally from the second region 248 into the third region 250, reaching a maximum at oval cross-section 256 in the third region 250. The major axes then decrease in length moving distally from the oval cross-section 256 through the remainder of the third region 250 and through the fourth region 252 reaching a minimum in the fourth region 252 near the junction between the fourth region 252 and the distal end portion 244 of the handle 240.

In addition, as illustrated in FIG. 10, the handle 240 is configured so that the rearward-most point 261 on the second, third, and fourth regions of the handle 40 is located at the distal end of the fourth region 252, such that point 261 is equal to or more rearward than any other point more proximal on the second, third, or fourth regions of the handle 240. The front-most point 263 on the second, third, and fourth portions of the handle 240 is located at the proximal end of the second region 248, such that point 263 is equal to or more forward than any other point more distal on the second, third, or fourth regions of the handle 240. The frontward edge 267 of the second, third, and fourth portions of the handle 40 tends to have a shape approximately like a bottom half of a parenthesis, with a slight curvature back in the frontward direction at the bottom of the parenthesis.

Referring to FIGS. 10 and 14A-14B, the first region 246 includes a semi-circular shaped thumb-forefinger recess 269 having a curvature configured to receive the web 112 between the user's thumb and forefinger. The trigger 231 travels along an imaginary line L'-L' that is substantially parallel to the tool holder axis X'-X' such that the forefinger 104 is pulled toward the thumb-forefinger recess 269.

Figure 13:
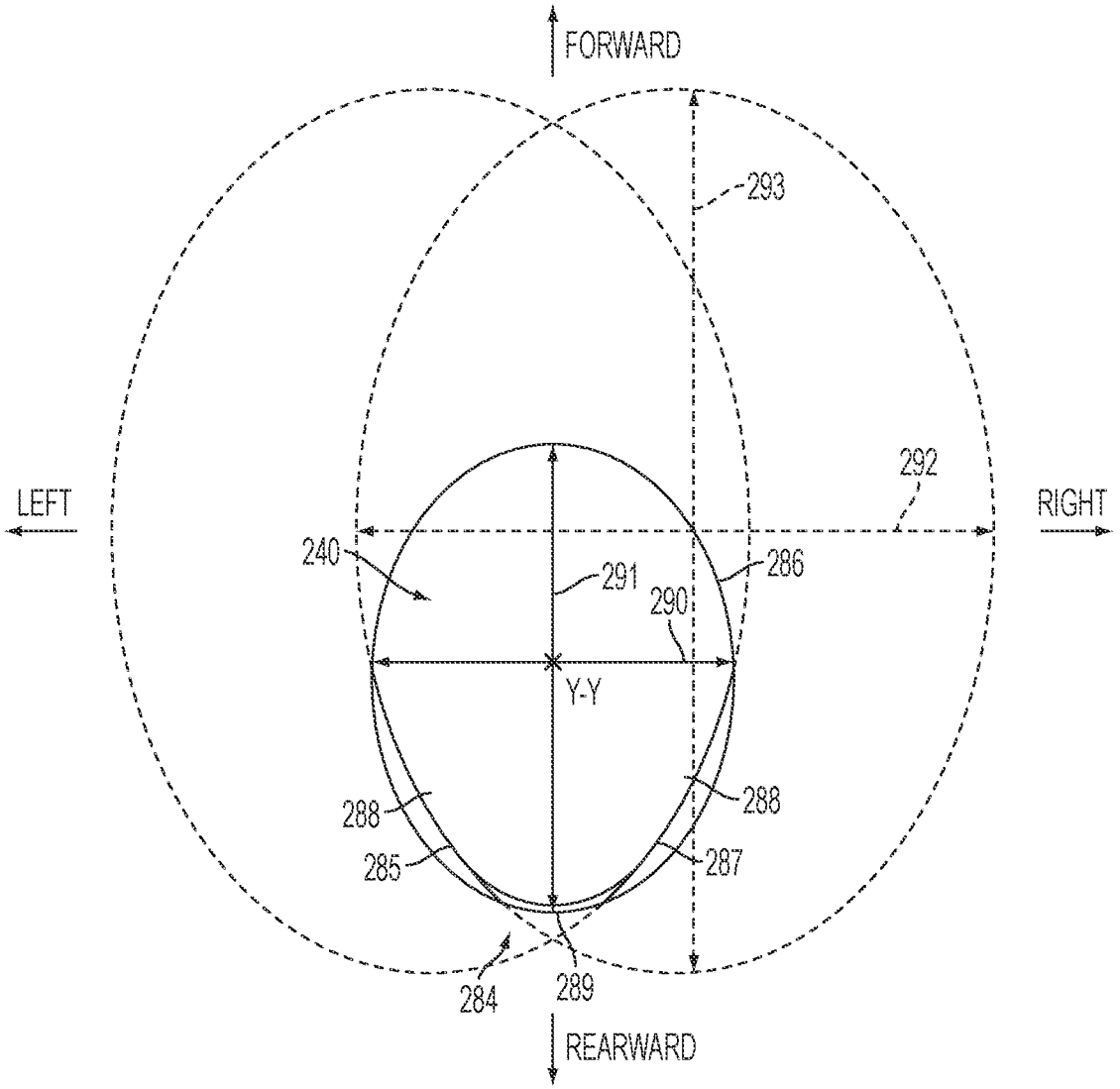
FIG. 13 is a cross-sectional view of the power tool of FIG. 10 taken along line 13-13.

Referring to FIGS. 10, 11, and 14A-14B, the fourth region 252 of the handle 240 includes a palm grip relief 284, which is configured to receive the hypothenar eminence 116 of the user's palm. The palm grip relief 284 wraps around the rear of the handle and is symmetrical on both sides of the handle. The palm grip relief includes a left portion 285 and a right portion 287 on opposite sides of the handle 240 that meet at a central portion 289. When viewed from the side view (i.e., as shown in FIG. 10), the left portion 285 and right portion 287 each have a generally C-shape. Referring also to FIG. 13, in cross-section C-C (taken through the handle at the palm-grip relief generally parallel to the tool bit holder axis X-X), the handle 240 has a first generally elliptical shape 286 with the left portion 285 and the right portion 287 of the palm grip relief 284 each having a second generally elliptical shape 288 that is different from the first generally elliptical shape 286. For example, the first generally elliptical shape 286 has a major axis 291 and a minor axis 290, each centered on the handle axis Y-Y, while each second elliptical shape 288 has a major axis 293 that is centered forward of the handle axis Y-Y and a minor axis 292 that is centered to the left or the right of the handle axis Y-Y. In addition, the major axis 293 and minor axis 292 of each second elliptical shape 288 are larger than the major axis 291 and minor axis 290, respectively, of the first elliptical shape 286. Further, each second elliptical shape 288 has a curvature that is different from that of the first elliptical shape 286. In other embodiments, the major and/or minor axes of the second elliptical shapes may be centered in different locations or be smaller than or equal to the major and/or minor axes of the first elliptical shape and/or the second elliptical shape may have a different curvature than that shown. In yet further embodiments, the shape of the left portion 285 and right portion 287 of the palm grip relief 284 may not be elliptical, but instead be a flattened portion, or may have a curvature that us inverse to that of the handle 240.

Referring to FIGS. 10 and 14A-14B, the handle 240 also includes a pair of finger support ridges 294 that run along each side of the handle. Each finger support ridge 294 has a first section 295 that starts adjacent to the junction of the second region 248 and the third region 250 extends in a rearward direction substantially parallel to the axis X'-X'. The ridge has a second section 296 that extends from the first section 295 and continues through the third region 250 at an angle that is more acute than the handle axis Y'-Y'. The ridge also has a third section 297 then continues through the fourth section and that extends forward and then distally approximately perpendicular to the axis X'-X'. The finger support ridge 294 is configured to abut against the fingertips of the user when the user is gripping the handle, in order to better grip the handle 240. Gripping surfaces 257 are disposed on either side of the finger support ridge 294 and are contoured like the finger support ridge 294. Gripping surfaces 257 are contoured to receive the user's fingertips on one side of the handle 240, while receiving the fleshy pads 120, 122, 124, and 126 on the user's palm other side of the handle 40.

A biomechanical evaluation was performed on a prototype of the first embodiment, power tool 10 and handle 40 described above, in accordance with internal protocols and referencing data tables set forth in Stephen Pheasant, Bodyspace: Anthropometry, Ergonomics and the Design of the Work, Second Edition (Taylor and Francis 2007) and Thomas M. Greiner; "Hand Anthropometry of US Army Personal," Army Natick Research Development and Engineering Center, Technical Report Natick/TR-92/011, December 1991. The prototype was substantially as described above except for lacking a thumb-knuckle resting portion 80, a palm grip relief 84, and a finger support ridge 94. The prototype was compared with a Bosch PS-20 drill, a Makita DF030D drill, and a Hitachi B10DL drill (collectively the "alternative tools").

In the biomechanical evaluation, human test subjects used the prototype and the alternative tools in work cycles designed to simulate using the tools to repeatedly insert Phillips head screws into wood. During each test cycle, the test subjects would use the tools to apply an axial load in the direction of the simulated application of approximately 25-30 pounds of force for 3 seconds, followed by 7 seconds of rest. This cycle would be repeated for durations of 2 minutes, 4 minutes, 6 minutes, and 10 minutes total, or until the test subjects became too fatigued or in too much discomfort to continue. Each test subject used each of the tools for these tests in a non-rotating order.

All of the test subjects ranked the prototype tool as being best or second best in the overall ergonomic comfort of the tool, with 75% of the test subjects ranking the prototype as the best among the tested tools. In addition, several test subjects identified problems with discomfort in the thumb joint area and the hypothenar eminence. This led to the design of the thumb knuckle resting portion 80 and the palm grip relief 84, respectively.

The foregoing description relates to only several possible embodiments and is not limiting. Numerous modifications can be made within the scope of the invention(s) disclosed above.

What is claimed is:

1. A power tool comprising:

a housing having a front end and a rear end;

a tool holder coupled to the front end of the housing and configured to hold a tool bit, the tool holder defining a tool holder axis;

a motor contained in the housing and configured to drive the tool holder via transmission gears;

a handle having a proximal end portion coupled to the housing and a distal end portion, the handle extending at an angle to the tool bit holder axis;

a battery receptacle coupled to the distal end portion of the handle and configured to receive a battery along a battery axis; and a trigger coupled to the handle and configured to control power delivery from the battery to the motor, wherein the handle comprises a first region adjacent the distal end portion to which the trigger is coupled, the first region having a first major axis and a first minor axis, a second region adjacent to and distal of the first region and of the trigger, the second region having a generally oval cross section with a second major axis and a second minor axis, a third region adjacent to and distal of the second region, the third region having a generally oval cross section with a third major axis and a third minor axis, a fourth region adjacent to and distal of the third region and adjacent to and proximal of the distal end portion, the fourth region having a generally oval cross section with a fourth major axis and a fourth minor axis, and the third major axis is longer than each of the second major axis and the fourth major axis, and the third minor axis and the fourth minor axis each are longer than the second minor axis.

2. The power tool of claim 1, wherein the fourth major axis is shorter than each of the second major axis and the third major axis.

3. The power tool of claim 1, wherein the fourth minor axis is longer than the third minor axis.

4. The power tool of claim 1, wherein the second and third major axes together define a rearward edge having a generally convex curvature with its forward-most point located in the second region.

5. The power tool of claim 4, wherein the second, third, and fourth major axes together define a forward edge having a generally convex curvature with its forward-most point located in the second region.

6. The power tool of claim 1, wherein the second, third, and fourth minor axes together define a left edge and a right edge, wherein the left edge and the right edge generally taper away from each other from the top region toward the bottom region.

7. The power tool of claim 1, wherein the first region further includes a concave thumb-forefinger recess on a rear of the first region.

8. The power tool of claim 1, wherein at least one of the second, third, and fourth regions includes a support ridge that runs along each lateral side face of the handle.

9. The power tool of claim 8, wherein the handle further comprises a plurality of horizontal gripping surfaces generally parallel to the tool holder axis that wrap around a front of the handle between the support ridges.

10. The power tool of claim 1, further comprising a battery pack that slides along the battery axis to be received in the battery receptacle, the battery axis substantially parallel to the tool holder axis.

11. A power tool comprising:

a housing having a front end and a rear end;

a tool holder coupled to the front end of the housing and configured to hold a tool bit, the tool holder defining a tool holder axis;

a motor contained in the housing and configured to drive the tool holder via transmission gears;

a handle having a proximal end portion coupled to the housing and a distal end portion, the handle extending at an angle to the tool bit holder axis;

a battery receptacle coupled to the distal end portion of the handle and configured to receive a battery along a battery axis; and a trigger coupled to the handle and configured to control power delivery from the battery to the motor, wherein the handle comprises a first region adjacent the distal end portion to which the trigger is coupled, the first region having a first major axis and a first minor axis, a second region adjacent to and distal of the first region and of the trigger, the second region having a generally oval cross section with a second major axis and a second minor axis, a third region adjacent to and distal of the second region, the third region having a generally oval cross section with a third major axis and a third minor axis, a fourth region adjacent to and distal of the third region and adjacent to and proximal of the distal end portion, the fourth region having a generally oval cross section with a fourth major axis and a fourth minor axis, and a front end of the third major axis is rearward of a front end of the second major axis and a front end of the fourth major axis is rearward of the front end of the third major axis, a rear end of the third major axis is rearward of a rear end of the second major axis and a rear end of the fourth major axis is generally even with the rear end of the third major axis, wherein the third major axis is longer than each of the second major axis and the fourth major axis, and wherein no minor axis is longer than the fourth minor axis.

12. The power tool of claim 11, wherein the fourth major axis is shorter than each of the second major axis and the third major axis.

13. The power tool of claim 11, wherein the fourth minor axis is longer than the third minor axis.

14. The power tool of claim 11, wherein the second and third major axes together define a rearward edge having a generally convex curvature with its forward-most point located in the second region.

15. The power tool of claim 14, wherein the second, third, and fourth major axes together define a forward edge having a generally convex curvature with its forward-most point located in the second region.

16. The power tool of claim 11, wherein the second, third, and fourth minor axes together define a left edge and a right edge, wherein the left edge and the right edge generally taper away from each other from the top region toward the bottom region.

17. The power tool of claim 11, wherein the first region further includes a concave thumb-forefinger recess on a rear of the first region.

18. The power tool of claim 11, further comprising a battery pack that slides along the battery axis to be received in the battery receptacle.

19. A power tool comprising:

a housing having a front end and a rear end;

a tool holder coupled to the front end of the housing and configured to hold a tool bit, the tool holder defining a tool holder axis;

a motor contained in the housing and configured to drive the tool holder via transmission gears;

a handle having a proximal end portion coupled to the housing and a distal end portion, the handle extending at an angle to the tool bit holder axis;

a battery receptacle coupled to the distal end portion of the handle and configured to receive a battery along a battery axis; and a trigger coupled to the handle and configured to control power delivery from the battery to the motor, wherein the handle comprises a first region adjacent the distal end portion to which the trigger is coupled, the first region having a first major axis and a first minor axis, a second region adjacent to and distal of the first region and of the trigger, the second region having a generally oval cross section with a second major axis and a second minor axis, a third region adjacent to and distal of the second region, the third region having a generally oval cross section with a third major axis and a third minor axis, a fourth region adjacent to and distal of the third region and adjacent to and proximal of the distal end portion, the fourth region having a generally oval cross section with a fourth major axis and a fourth minor axis, and the third major axis is longer than each of the second major axis and the fourth major axis, and the fourth major axis is shorter than each of the second major axis and the third major axis, and the third minor axis and the fourth minor axis each are longer than the second minor axis, and a rear end of the third major axis is rearward of a rear end of the second major axis and a rear end of the fourth major axis is generally even with the rear end of the third major axis, and the second and third major axes together define a rearward edge having a generally convex curvature with its forward-most point located in the second region, the second, third, and fourth major axes together define a forward edge having a generally convex curvature with its forward-most point located in the second region, the second and third minor axes together define a left edge and a right edge that generally taper away from each other from the top region toward the bottom region, and the first region further includes a concave thumb-forefinger recess on a rear of the first region.

20. The power tool of claim 19, further comprising a battery pack that slides along the battery axis to be received in the battery receptacle.

* * * * *